US008418948B2

(12) United States Patent
Martin et al.

(10) Patent No.: US 8,418,948 B2
(45) Date of Patent: Apr. 16, 2013

(54) COLLAPSIBLE STORAGE AND TRANSPORTATION SYSTEM

(75) Inventors: Randy Martin, Vermilion (CA); Ryan Martin, Vermilion (CA); Denis Martin, Vermilion (CA); Vern Howrish, Spirit River (CA); Bruce Lyon, Airdrie (CA); Eric Schmelzl, Calgary (CA); Gord McIntosh, Calgary (CA); Nathan Zacharias, Vermilion (CA); John Garden, Calgary (CA)

(73) Assignee: Rock Solid Rentals Ltd, Vermilion (CA)

( * ) Notice: Subject to any disclaimer, the term of this patent is extended or adjusted under 35 U.S.C. 154(b) by 0 days.

(21) Appl. No.: 13/300,677

(22) Filed: Nov. 21, 2011

(65) Prior Publication Data

US 2012/0063703 A1 Mar. 15, 2012

Related U.S. Application Data

(62) Division of application No. 12/471,245, filed on May 22, 2009, now Pat. No. 8,083,169.

(30) Foreign Application Priority Data

Apr. 8, 2009 (CA) ..... 2661680

(51) Int. Cl.
*B65D 33/00* (2006.01)
*B65H 75/40* (2006.01)

(52) U.S. Cl.
USPC ..... 242/403; 220/723; 222/99; 242/390.5; 383/41; 383/100; 383/103; 383/104; 383/904; 383/906

(58) Field of Classification Search ..... 220/9.4, 220/666, 720, 723, 904, 905; 222/92, 95, 222/96, 98, 99, 100, 101, 102; 242/390.5, 242/390.6, 403, 533.8; 383/41, 100, 101, 383/103, 104, 904, 906
See application file for complete search history.

(56) References Cited

U.S. PATENT DOCUMENTS

| | | | |
|---|---|---|---|
| 2,851,075 | A | 9/1958 | Palfrey |
| 2,915,097 | A | 12/1959 | Lewis |
| 2,958,478 | A | 11/1960 | Peterson et al. |
| 2,969,102 | A | 1/1961 | Cunningham |
| 2,973,293 | A | 2/1961 | Schofield |
| RE26,659 | E | 9/1969 | Siegal |

(Continued)

FOREIGN PATENT DOCUMENTS

| | | | |
|---|---|---|---|
| AU | 2010201255 | A1 | 10/2010 |
| CA | 2661680 | A1 | 10/2009 |
| CA | 2689844 | A1 | 10/2009 |
| WO | 2010/115262 | A1 | 10/2010 |

*Primary Examiner* — Kevin Hurley
*Assistant Examiner* — Marc A Scharich
(74) *Attorney, Agent, or Firm* — Matthew F. Lambrinos

(57) ABSTRACT

A flexible fluid storage system for holding large volumes of fluid and a process and apparatus for the handling and transportation of the flexible storage system is provided. The flexible storage system includes a main storage bag with an attachment apron with fingers, a ground sheet, a lay flat tube for fluid circulation, a pressure release port, and fill/drain ports. The flexible storage system is configured for attachment to a trailer and reel system such that the flexible storage system can be mechanically rolled onto or off of a reel on a semi-truck trailer bed for easy transportation, deployment, and storage of the flexible storage system.

21 Claims, 7 Drawing Sheets

U.S. PATENT DOCUMENTS

| | | | | |
|---|---|---|---|---|
| 3,934,854 | A | 1/1976 | Goode | |
| 4,148,445 | A | 4/1979 | Reynolds | |
| 4,161,263 | A | 7/1979 | Wagner | |
| 4,454,999 | A | 6/1984 | Woodruff | |
| 4,573,508 | A | 3/1986 | Knaus | |
| 4,632,329 | A | 12/1986 | Burley | |
| 4,998,595 | A | 3/1991 | Yeh | |
| 5,199,793 | A | 4/1993 | Jackson | |
| RE34,488 | E | 12/1993 | Clark | |
| 5,735,219 | A | 4/1998 | Kirker | |
| 6,260,790 | B1 | 7/2001 | Harrah | |
| 6,315,233 | B1 | 11/2001 | Van Wingerden | |
| 6,419,424 | B1 | 7/2002 | Null et al. | |
| 6,550,410 | B2 * | 4/2003 | Reimers | 114/256 |
| 6,726,052 | B1 | 4/2004 | Miller | |
| 6,860,218 | B2 * | 3/2005 | Eagles et al. | 114/256 |
| 6,889,484 | B1 * | 5/2005 | Garvin et al. | 53/434 |
| 6,981,613 | B1 * | 1/2006 | Kamisugi | 222/105 |
| 6,991,050 | B1 | 1/2006 | Sanford et al. | |
| 7,213,970 | B1 | 5/2007 | Reicin et al. | |
| 7,344,426 | B1 | 3/2008 | Dysthe | |
| 8,083,169 | B2 * | 12/2011 | Martin et al. | 242/403 |
| 2005/0189357 | A1 | 9/2005 | Moizumi | |
| 2010/0130957 | A1 * | 5/2010 | Smisson et al. | 604/406 |

* cited by examiner

COLLAPSIBLE STORAGE AND TRANSPORTATION SYSTEM

CROSS REFERENCE TO RELATED APPLICATIONS

This application is a divisional of U.S. patent application Ser. No. 12/471,245, now U.S. Pat. No. 8,083,169.

FIELD OF THE INVENTION

This application relates to collapsible fluid storage containers and a system for handling and transporting collapsible fluid storage containers.

BACKGROUND OF THE INVENTION

Large temporary storage containers are frequently needed in certain industries for the transportation and storage of large quantities of fluids. Specifically, in the oil and gas industry, and particularly for fracturing operations, there has been an increasing need for larger volumes of fracturing fluids (up to 6000-7000 $m^3$) to be available at a well site for use during a well fracturing operation over several days. Presently, steel tanks that are capable of holding in the order of 60 $m^3$ of fluid are used for storing fracturing fluids at oil well sites. The disadvantage of steel tanks is their limited capacity and the space they require for transportation, as generally only two steel tanks can be transported on a single truck trailer bed. Thus, a single truck trailer can transport a water storage system capable of holding only 120 $m^3$ of fluid.

As flexible storage bags can be collapsed, when empty they require significantly less space during transportation. However, in the past they have been difficult to handle and typically require a large amount of manual labor for set-up and dismantling. In addition, such bag systems are particularly prone to malfunction in various deployments such as remote oil well sites as a result of the climate and terrain such systems are subjected to. Accordingly, there has been a need for improved systems for transporting and storing large volumes of fluid (particularly water) at a well site that also minimizes the risk of malfunction. In particular, there has been a need for improved flexible bag systems that increase the overall efficiency of transportation and storage for significantly larger volume bag systems for use at oil wells and for fracturing operations.

A review of the prior art reveals that flexible collapsible storage bags are well-known in industrial and military applications for the storage of fluids. For example, various systems have been described in U.S. Pat. No. 2,915,097; U.S. Pat. No. 2,851,075; U.S. Pat. No. 2,973,293; U.S. Pat. No. 4,573,508; U.S. Pat. No. 5,199,793; U.S. Pat. No. 6,726,052; and U.S. Pat. No. 7,213,970.

SUMMARY OF THE INVENTION

In accordance with the invention, there is provided a trailer and reel system for transporting a flexible fluid storage system, comprising; a trailer body having a front end and a rear end, the trailer body operatively supporting trailer wheels; first and second pivot wheel sets located at the front and rear ends of the trailer body respectively and positioned 90 degrees relative to the trailer wheels, the pivot wheel sets including: extension members attached to the trailer body and each pivot wheel of the pivot wheel sets for enabling independent vertical movement of each pivot wheel with respect to the trailer body; and a hydraulic drive system operatively attached to the pivot wheels and the extension members for enabling independent vertical movement of the extension members and each pivot wheel and operative rotation of the pivot wheels; and, a reel and support system on the trailer body including: a reel having first and second ends and a connection system for operatively connecting a flexible storage system to the reel; a first support frame attached to the front end of the trailer body for operative engagement with the first end of the reel; a second support frame attached to the rear end of the trailer body for operative engagement with the second end of the reel; and, a drive system for operative movement of the reel enabling a flexible storage system to be wound onto the reel.

In a further embodiment, the drive system includes a hydraulic motor and first and second drive gears on first and second ends of the reel, the hydraulic motor for operative and selective connection to each of the first and second drive gears.

In another embodiment, the connection system includes a series of hooks along the length of the reel for operative engagement with corresponding slots on the flexible storage system.

In yet another embodiment, the reel enables interchangeable connection of the first end of the reel with the first support system and the second support system, and vice versa with the second end of the reel.

In a further embodiment, the reel includes a first and second tapered mounting fitting and first and second drive gear on the first and second reel ends to facilitate multidirectional operation of the reel and reel interchangeability.

In another aspect of the invention, a flexible storage bag is provided comprising: a bag body having top and bottom surfaces and front and back ends; an apron attached to the top and bottom surfaces at the front end, the apron having a reel attachment end for attachment to a reel; a plurality of fill/drain ports located on the back end of the flexible storage bag for filling or draining the bag body of fluid; a flexible tube located inside the bag body, the flexible tube attached at one end to a fill/drain port to allow for water circulation within the storage bag; and, an air pressure release port located on the top of the bag for the release or equalization of air pressure within the bag.

In one embodiment, the apron includes a series of fingers on the reel end of the apron and each finger includes a slot for operative engagement with a reel.

In yet another embodiment, each fill/drain port includes a sleeve on the side of the fill/drain port inside the bag, wherein each sleeve includes a plurality of slots in the sleeve for preventing the bag from being suctioned into the fill/drain port.

BRIEF DESCRIPTION OF THE DRAWINGS

The invention is described with reference to the accompanying figures in which.

DETAILED DESCRIPTION OF THE INVENTION

Overview

With reference to the figures, a flexible fluid storage system (FSS) 10 and process and apparatus for the handling the flexible storage system are described.

Figure 1:
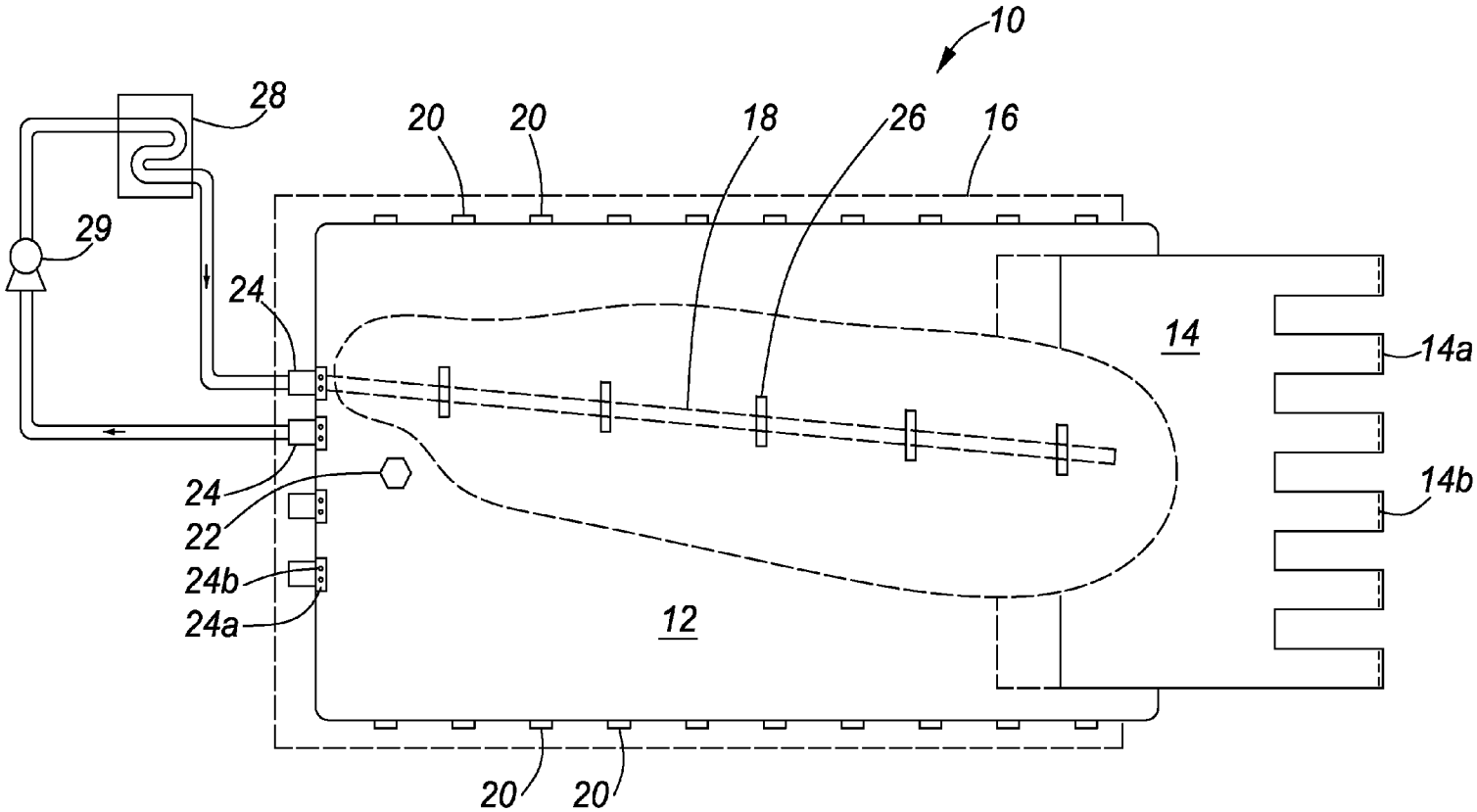
FIG. 1 is a plan view of a collapsible storage tank and heating system in accordance with one embodiment of the invention.
Figure 4:
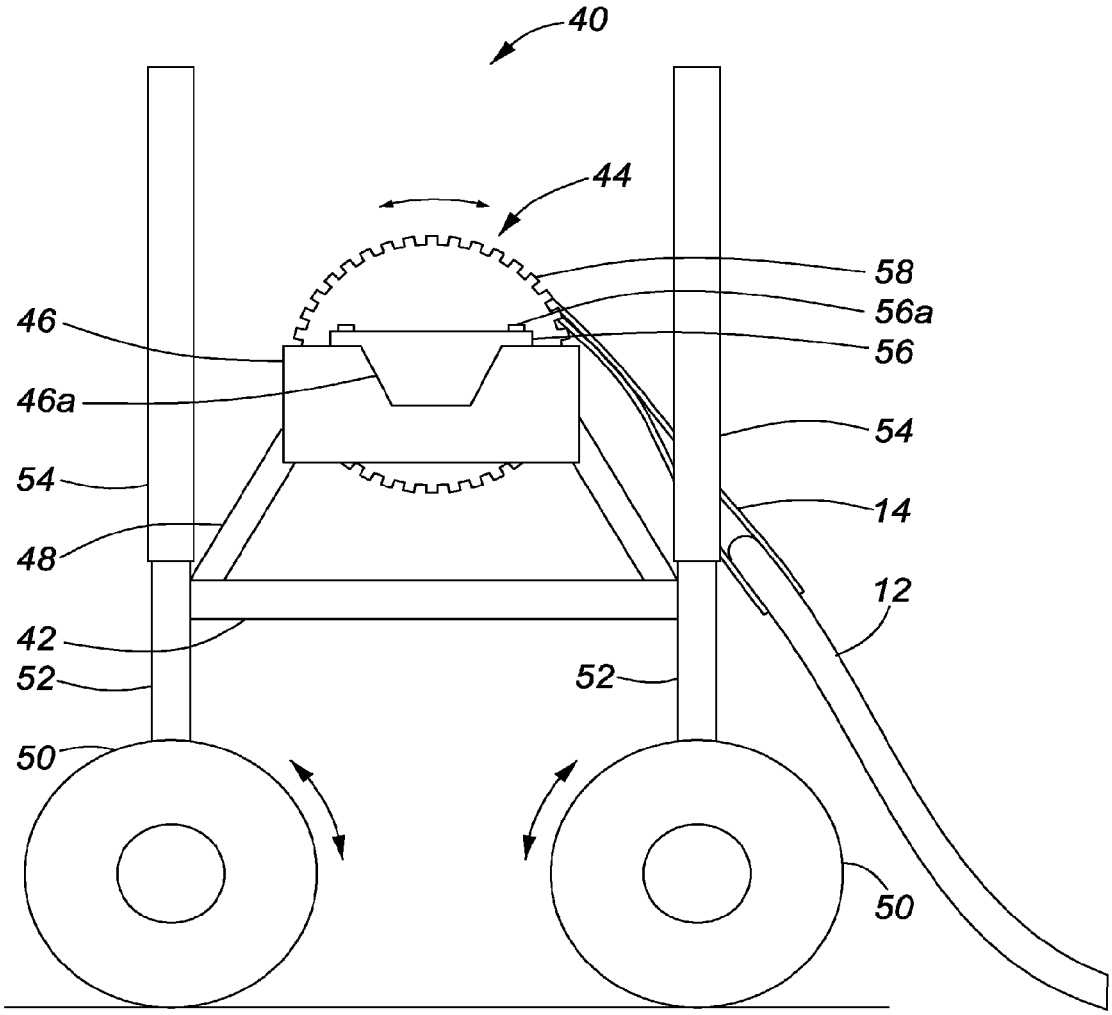
FIG. 4 is an end view of a trailer and reel system for handling a collapsible storage tank in accordance with one embodiment of the invention.

As shown in FIG. 1, the FSS generally includes a main storage bag 12, attachment apron 14 with fingers 14*a*, ground sheet 16, lay flat tube 18, grommets 20, pressure release port 22, and fill/drain ports 24. As shown in FIGS. 4 and 5, the FSS is configured for attachment to a trailer and reel system (TRS) 40 that includes a reel 44 with a drive gear 58 and a tapered fitting 56, a trailer bed 42 equipped with a support 46 on a frame system 48, and two sets of pivot wheels 50 (positioned at 90° to regular trailer wheels 70) that are attached to lifting members 52 that move vertically within support members 54.

The Flexible Storage System

FSS

The FSS 10 is a large flexible bag having a generally rectangular shape with rounded corners that is fabricated from a suitable polymer alloy coated material as known to those skilled in the art. In a preferred embodiment, the FSS can hold a volume of fluid upwards of 145,000-155,000 US gallons (550-587 $m^3$). When full, a 155,000 US gallon (587 $m^3$) bag measures approximately 100 feet (30 m) long, 47 feet (14 m) wide, and 5 feet (1.5 m) tall.

The groundsheet 16 may be permanently affixed to the bag for easy deployment when rolling or unrolling the bag, or in other embodiments may be temporarily secured to the main storage bag by ropes or similar devices secured to the grommets 20 spaced evenly on both sides of the storage bag and midway between the top and bottom of the bag. The storage bag is generally free-standing when full or partially full and does not require further supports.

The pressure release port 22 is located on the top of the storage bag to allow for air pressure to be manually vented or equalized when the storage bag is being filled or drained. The fill/drain ports 24 are preferably located on the end of the storage bag midway between the top and bottom of the bag in a horizontal row. The fill/drain ports include a sleeve 24*a* on each fill/drain port on the inside the bag, wherein each sleeve has a plurality of slots 24*b* in the sleeve to prevent the bag itself from being suctioned into the fill/drain port during the emptying of the bag.

Lay-Flat Tube

Figure 3:
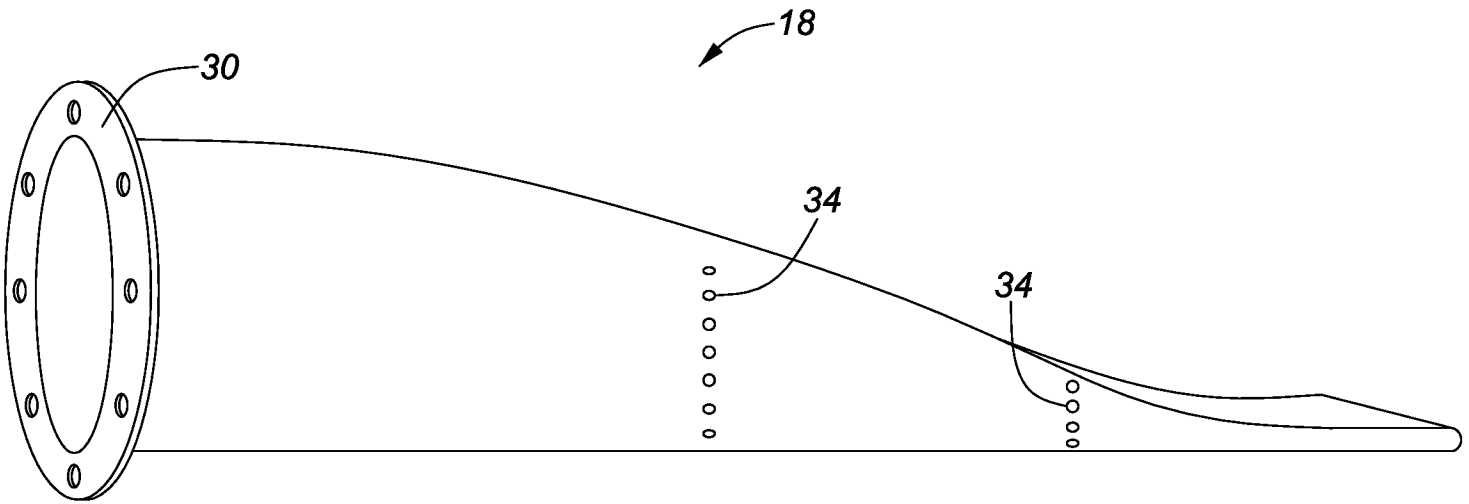
FIG. 3 is a perspective view of a lay flat tube of a collapsible storage tank in accordance with one embodiment of the invention.

As seen in the cut-away of FIG. 1 and in FIG. 3, the lay flat tube 18 is a flexible tube located and loosely configured to the inside of the storage bag for enabling the circulation of fluid within the FSS when full. The lay flat tube includes a flange 30 on one end that is fit into a fill/drain port 24. The opposite end of the tube is open. The lay flat tube is preferably the length of the storage bag wherein the tube lies from end to end of the bag and is loosely secured to the inside bottom of the bag by a series of tie down strips 26, located inside the bag. The lay flat tube is generally 4 to 8" in diameter and is flexible to allow the tube to be rolled up with the bag. A plurality of drainholes 34, measuring approximately ½" in diameter are punched in the lay flat tube around the circumference of the tube to allow for the release of fluid from the tube when the bag is in the process of being rolled up so as to prevent pockets of water becoming trapped within the lay flat tube.

The function of the lay flat tube is to enable the circulation of fluid within the bag when the temperature is below freezing. During cold weather, cold fluid within the bag is pumped out of the bag by means of a pump 29 through a fill/drain port 24, heated within a heating system 28, and subsequently pumped back into a second fill/drain port wherein the lay flat tube is secured to the second fill/drain port on the inside of the bag. As a result, the heated fluid is pumped to the opposite end of the bag through the lay flat tube, thereby promoting circulation of fluid within the bag and moderate heating of the fluid to aid in preventing freezing of the fluid.

The Attachment Apron

Figure 2A:
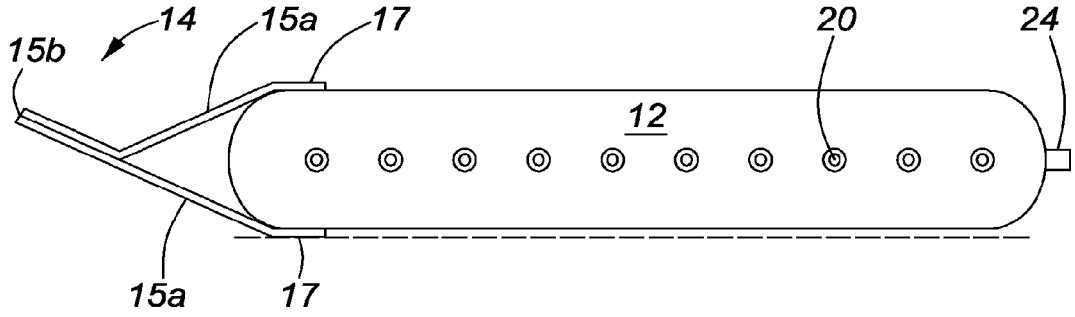
FIG. 2*a* is a side view of a collapsible storage tank in accordance with one embodiment of the invention.
Figure 2B:
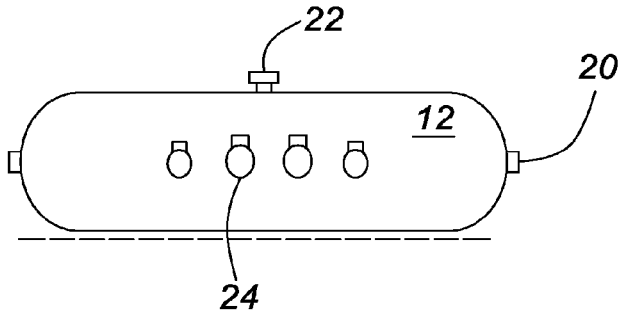
FIG. 2*b* is an end view of a collapsible storage tank in accordance with one embodiment of the invention.
Figure 5A:
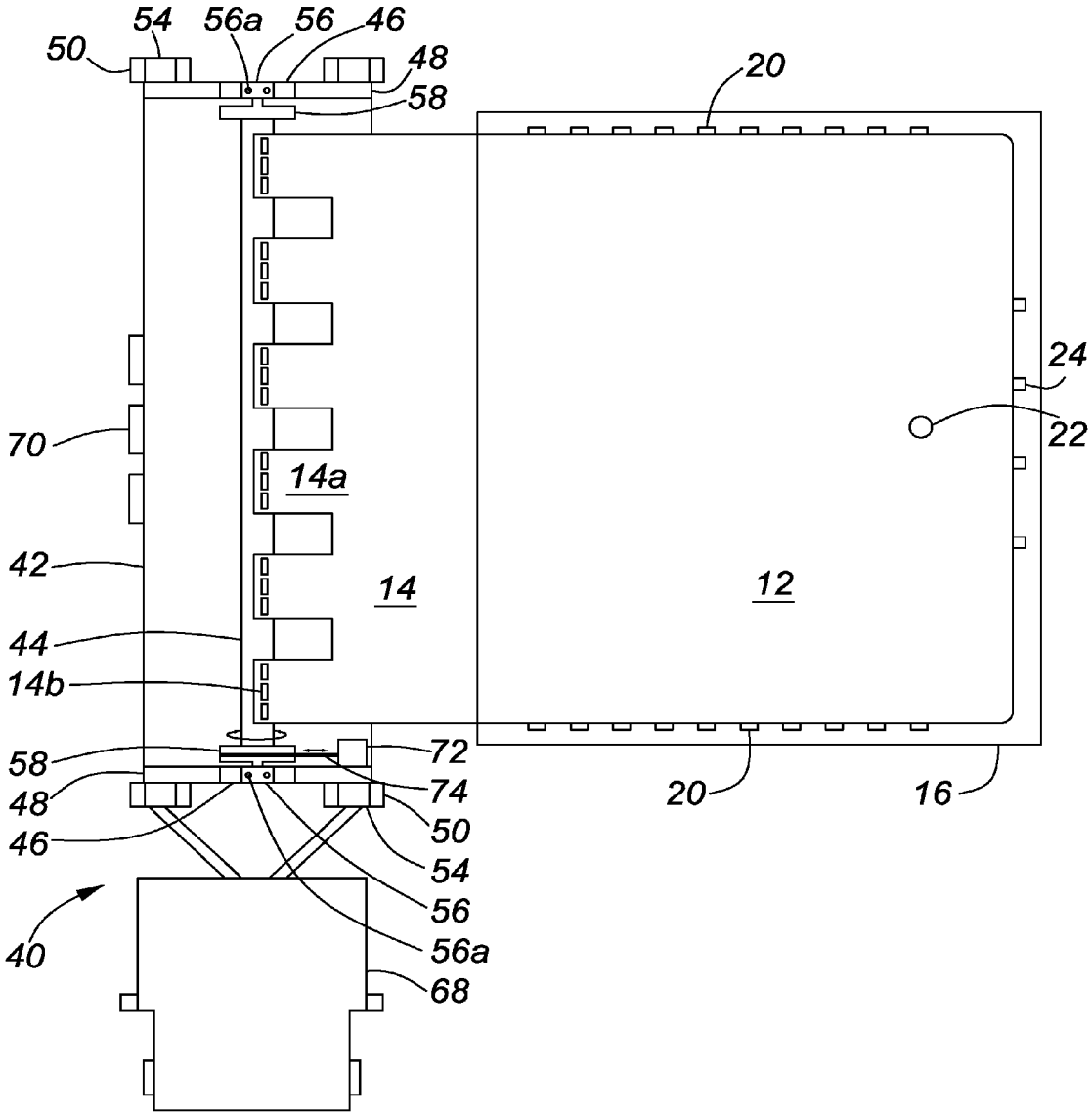
FIG. 5*a* is a plan view of a collapsible storage tank attached to a trailer and reel system in accordance with one embodiment of the invention.
Figure 5B:
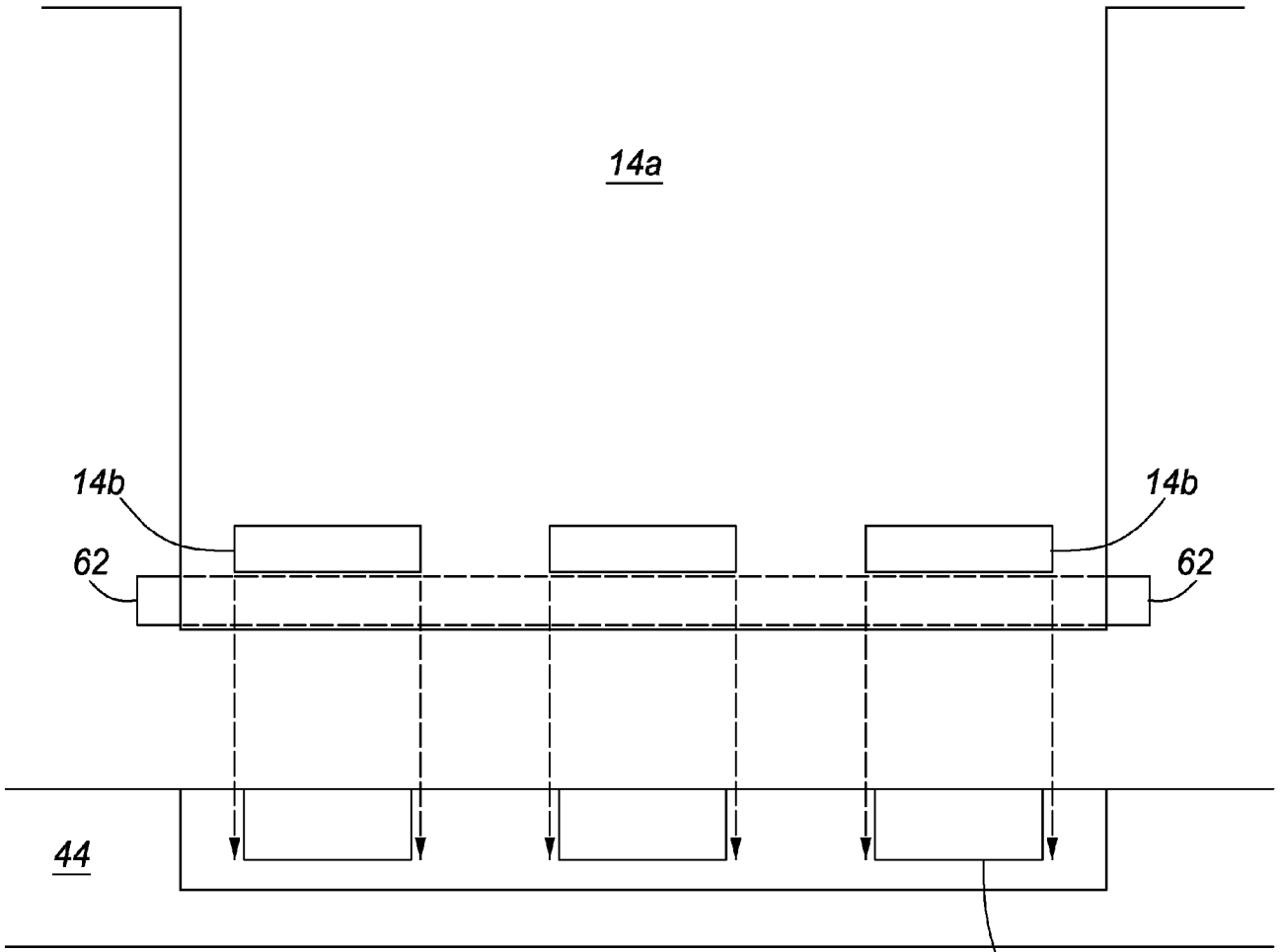
FIG. 5*b* is a plan view of an apron finger and a system for the apron finger to attach to hooks on a reel.
Figure 5C:
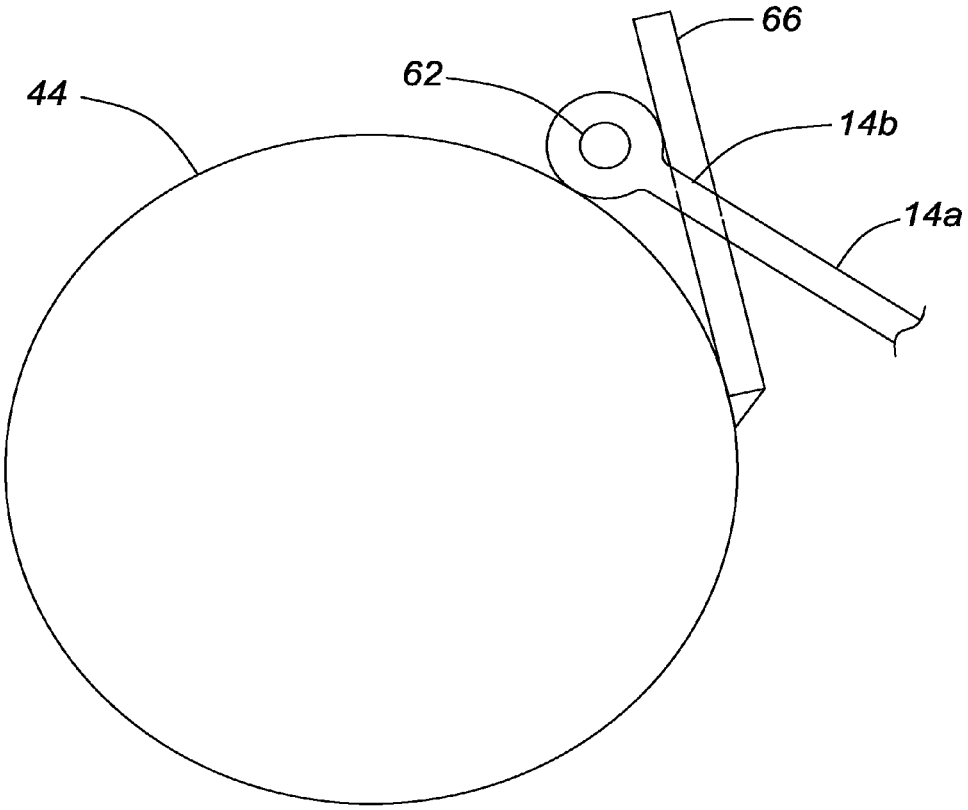
FIG. 5*c* is a cross-sectional view of an apron finger attached to a hook on a reel.

First ends 15*a* of the apron 14 are attached to the top and bottom surfaces 17 of the storage bag as best shown in FIG. 2*a*. A second end 15*b* of the apron is formed with a series of fingers 14*a* for attachment to the reel 44. As best shown in FIG. 5*b* and FIG. 5*c*, the tip of each finger consists of a double layer of material formed with a slot 14*b* and reinforcing member 62, such as a rope, secured between the layers for providing reinforcement and specifically to resist the tearing of the slot. The reel 44 is provided with a series of tabs 66 that run along the top of the reel in the areas where the apron fingers attach. Each of the slots 14*b* on the apron fingers hook over the tabs 66 such that the reinforcing member and the material of the finger covering the reinforcing member rest behind the tab 66 welded on the reel. The function of the apron is to allow for the even distribution of force on the FSS when winding the FSS onto the reel and to assist in the attachment of the FSS to the reel.

Trailer and Reel System

TRS

The TRS is a specialized trailer and reel system 40 for transporting an FSS to and from a job site and for deployment and recovery of the FSS at the job site. As best shown in FIG. 4 and FIG. 5*a*, the TRS 40 is similar to a regular flat bed trailer for hauling with a semi-truck 68 with a support system enabling an FSS and reel to be operatively supported on the trailer bed 42. The front and rear of the trailer and reel system each include a system of pivot wheels 50 oriented at 90 degrees to the main trailer wheels 70. In addition, the front end includes a hydraulic motor 72 and hydraulic control system that serves three purposes: independent control of the rotation of each pivot wheel, control of the vertical lifting mechanism, and operative control of a chain drive system for rotation of the reel.

Pivot Wheel System

Each set of pivot wheels 50 located at the front and rear end of the TRS are attached to the lifting members 52 that can move vertically within the support members 54 by means of the hydraulic control system. During the transportation of the FSS with the TRS, the pivot wheels are positioned such that the lifting members are fully within the support members such that the pivot wheels are in the highest position off the ground. At the job site, the semi-truck 68 is detached from the TRS and the lifting members and pivot wheels are lowered to the ground by means of the hydraulic control system such that the pivot wheels are carrying the load of the TRS and the regular trailer wheels are lifted off the ground.

The hydraulic control system can drive each set of pivot wheels independently in both a clockwise and counterclockwise direction such that the TRS can be moved in a variety of ways: pivoting in either direction about a centre point on the TRS, pivoting in either direction about either the front or rear end of the TRS, and moving laterally in either direction perpendicular relative to the reel on the TRS. This range of movement allows for the TRS to be positioned in a precise location for the easy deployment or recovery of the FSS on a job site, to move the TRS laterally toward the FSS during recovery of said FSS to prevent the FSS from being dragged along the ground, and to move the TRS laterally away from the FSS during the deployment of said FSS to allow for the FSS to be laid flat along the ground.

The Reel and Support System

As best shown in FIG. 4 and FIG. 5*a*, the reel and support system includes the support system with the frame 48 attached to the front and rear end of the trailer bed 42, the support 46 attached to the top of the frame, and the tapered mounting bracket 46*a* located at the top of the support. The reel system 44 includes the drive gear 58 mounted at both ends of the reel for the interchangeability and multidirectional use of the reels, the tapered fitting 56 that slides into the tapered mounting bracket on the trailer, the removable bolts 56*a* that extend vertically through the tapered fitting 56 and attach to the tapered mounting bracket support 46 below.

The motor 72 located at the front end of the TRS drives a chain 74 that wraps around the drive gear 58 located at the end of the reel positioned at the front end of the TRS. The motor drives the chain to rotate the drive gear in either direction such that the reel is able to rotate clockwise or counterclockwise such that the FSS attached to the reel is rolled onto or off the reel, and on or off either side of the trailer. As the reel is interchangeable with another reel and can be flipped end to end, the chain is required to be removable from the drive gear. Loosening a bolt located on the motor creates slack in the chain that allows the chain to be easily removed from or placed on the drive gear.

The reel system is not fixed to the support system, as upon removal of the bolts 56*a* in the tapered fitting at each end of the reel, and the removal of the chain from the drive end, the entire reel system, including the reel 44, the drive gear 58 and the tapered fitting 56, can be lifted vertically out of the support system by means of a separate crane system (not shown). To return the reel system back onto the support system, the reel is lowered by the crane and the tapered fittings on both ends of the reel are guided into the tapered mounting brackets 46*a* on the supports 46. Once the tapered fittings on both ends of the reel are resting in the tapered slots, the reel is secure. Optionally, the bolts 56*a* can be inserted into the tapered fitting to secure the fitting to the support for an extra safety measure. As both ends of the reel 44 have a drive gear and are both capable of being chain-driven by the motor, the reel can be flipped end to end on the trailer to allow the FSS to be deployed or recovered from either side of the TRS.

Operationally, the removable reel system can be effectively utilized to substantially decrease the operating costs of the FSS and increase the ease of use of the FSS. When transporting more than one FSS to a job site, each FSS is rolled up on a reel and transported on a semi truck and trailer with more than one FSS on a reel being able to fit on one trailer. This limits transportation costs, as approximately three 587 $m^3$ (155,000 US gallon) storage bags can be transported on one trailer, compared to two 60 $m^3$ (16,800 US gallon) steel storage tanks that are generally transported on one flatbed truck in accordance with presently used systems.

Upon deployment or recovery of a FSS at a job site, the reel can be removed from the support system on the TRS and a second reel can be placed on the support system for the successive deployment or recovery of a second FSS. As changing reels is simple and quick with the reel and support system, it is easy to use more than one FSS at a job site when a greater volume of fluid storage is required.

The invention claimed is:

1. A flexible storage bag comprising:

a bag body having top and bottom surfaces and front and back ends;

an apron attached to the top and bottom surfaces at the front end of the bag body, the apron having a reel attachment end for attachment to a reel;

a plurality of fill/drain ports located on the back end of the bag body for filling or draining the bag body of fluid;

a flexible tube located inside the bag body, the flexible tube attached at one end to a fill/drain port and extending a distance from the fill/drain port towards the front end of the bag body to enable fluid circulation within the bag body when fluid is pumped from one fill/drain port and returned to another fill/drain port; and, an air pressure release port for the release or equalization of air pressure within the bag body.

2. A flexible storage bag as in claim 1 wherein the apron includes a series of fingers on the reel attachment end of the apron and wherein each finger includes a slot for operative engagement with a reel.

3. A flexible storage bag as in claim 2 wherein each fill/drain port includes a sleeve on each fill/drain port on the inside of the bag body, wherein each sleeve includes a plurality of slots in the sleeve for preventing the bag body from being suctioned into the fill/drain port.

4. A flexible storage bag as in claim 3 wherein the bag body includes attachment means for selectively attaching a groundsheet to the bag body.

5. A flexible storage bag as in claim 4 wherein the attachment means are grommets.

6. A flexible storage bag as in claim 5 wherein the air pressure release port is located on the top surface of the bag body.

7. A flexible storage bag as in claim 6 wherein the flexible storage bag is free-standing when full or partially-full.

8. A flexible storage bag as in claim 7 wherein the bag body has an internal volume of 550-587 $m^3$.

9. A flexible storage bag as in claim 3 further comprising a groundsheet permanently fixed to the bag body.

10. A flexible storage bag as in claim 5 wherein the fill/drain ports are located midway between the top and bottom surfaces of the bag body in a horizontal row.

11. A flexible storage bag as in claim 1 wherein the bag body includes attachment means for selectively attaching a groundsheet to the bag body.

12. A flexible storage bag as in claim 11 wherein the attachment means are grommets.

13. A flexible storage bag as in claim 1 wherein each fill/drain port includes a sleeve on each fill/drain port on the inside of the bag body, wherein each sleeve includes a plurality of slots in the sleeve for preventing the bag body from being suctioned into the fill/drain port.

14. A flexible storage bag as in claim 1 further comprising a groundsheet permanently fixed to the bag body.

15. A flexible storage bag as in claim 1 wherein the flexible storage bag is free-standing when full or partially-full.

16. A flexible storage bag as in claim 1 wherein the fill/drain ports are located midway between the top and bottom surfaces of the bag body in a horizontal row.

17. A flexible storage bag as in claim 1 wherein the air pressure release port is located on the top surface of the bag body.

18. A flexible storage bag as in claim 1 wherein the bag body has an internal volume of 550-587 $m^3$.

19. The flexible storage bag of claim 1 wherein the flexible tube has a plurality of drainholes.

20. The flexible storage bag of claim 1 further comprising at least one tie down strip loosely securing the flexible tube to the bag body.

21. A flexible storage bag comprising:

a bag body having top and bottom surfaces and front and back ends;

an apron attached to the top and bottom surfaces at the front end of the bag body, the apron having a reel attachment end for attachment to a reel and a series of fingers on the reel attachment end of the apron and wherein each finger includes a slot for operative engagement with a reel;

a plurality of fill/drain ports located generally midway between the top and bottom surfaces of the bag body in a horizontal row on the back end of the bag body for filling or draining the bag body of fluid wherein each fill/drain port includes a sleeve on each fill/drain port on the inside of the bag body, and wherein each sleeve includes a plurality of slots in the sleeve for preventing the bag body from being suctioned into the fill/drain port;

a flexible tube located inside the bag body, the flexible tube attached at one end to a fill/drain port and extending a distance from the fill/drain port towards the front end of the bag body to enable fluid circulation within the bag body when fluid is pumped from one fill/drain port and returned to another fill/drain port;

an air pressure release port located on the top surface of the bag body for the release or equalization of air pressure within the bag body; and, a groundsheet for attachment to the bag body wherein the groundsheet is permanently or temporarily attached to the bag body by attachment means.

* * * * *